US005184177A

United States Patent [19]

Kikuchi et al.

[11] Patent Number: 5,184,177

[45] Date of Patent: Feb. 2, 1993

[54] ELECTROPHOTOGRAPHIC PRINTING APPARATUS

[75] Inventors: Hiroshi Kikuchi; Shigeki Nakajima; Hisao Ono; Yoshiharu Momiyama, all of Tokyo, Japan

[73] Assignee: OKI Electric Industry Co., Ltd., Tokyo, Japan

[21] Appl. No.: 648,208

[22] Filed: Jan. 31, 1991

[30] Foreign Application Priority Data

Feb. 6, 1990 [JP] Japan ..... 2-25159

[51] Int. Cl.[5] ..... G03G 21/00

[52] U.S. Cl. ..... 355/200; 355/260

[58] Field of Search ..... 355/260, 200, 210, 211, 355/245; 346/155, 160.1

[56] References Cited

U.S. PATENT DOCUMENTS

| | | | |
|---|---|---|---|
| 3,651,838 | 3/1972 | Albert | 141/284 |
| 4,233,611 | 11/1980 | Nakano et al. | 346/155 X |
| 4,757,344 | 7/1988 | Idenawa et al. | 355/260 |
| 4,866,482 | 9/1989 | Hirasawa et al. | 355/260 |
| 4,905,028 | 2/1990 | Okubo et al. | 346/160 |
| 4,954,844 | 9/1990 | Morita et al. | 355/260 |
| 4,974,023 | 11/1990 | Aimoto et al. | 355/260 X |
| 4,975,744 | 12/1990 | Ebata et al. | 355/211 |
| 4,987,446 | 1/1991 | Mochimaru et al. | 355/200 |

FOREIGN PATENT DOCUMENTS

| | | |
|---|---|---|
| 352121 | 1/1990 | European Pat. Off. . |
| 8705870 | 4/1987 | Fed. Rep. of Germany . |
| 58-54392 | 5/1983 | Japan . |
| 147764 | 1/1984 | Japan . |
| 294468 | 6/1985 | Japan . |
| 63-11640 | 1/1988 | Japan . |

*Primary Examiner*—A. T. Grimley
*Assistant Examiner*—Robert Beatty
*Attorney, Agent, or Firm*—Edward D. Manzo; Ted K. Ringsred

[57] ABSTRACT

In an electrophotographic printing apparatus which includes a photosensitive drum having a photoconductive layer on its surface, a primary charger for uniformly charging the surface of the photosensitive drum, a developing agent tank for containing powder developing agent, a developing system for supplying the powder developing agent supplied from the developing agent tank to the surface of the photosensitive drum, and a cleaner for removing the powder developing agent from the surface of the photosensitive drum. The photosenstivie drum, the primary charger, the developing system, a container for the developing agent tank, and the cleaner are integrally mounted to a support member to form an image-forming cartridge. This cartridge is removably mounted to a main body of the electrophotographic printing apparatus, and the developing agent tank is removably mounted in the container of the cartridge.

6 Claims, 7 Drawing Sheets

ELECTROPHOTOGRAPHIC PRINTING APPARATUS

FIELD OF THE INVENTION

The present invention relates to an electrophotographic printing apparatus in which a visible image corresponding to an electrostatic latent image formed on a photosensitive drum is formed by a power developing agent, and this visible image is transferred to a printing paper thereby to achieve printing, and more particularly an electrophotographic printing apparatus in which a developing device, a photosensitive member, a cleaner and the like are integrated into a single cartridge which is exchangeable.

BACKGROUND OF THE INVENTION

A conventional electrophotographic apparatus of the above type is shown in Japanese Patent Kokoku Publication No. 54,392/1983. In this apparatus, in an electrophotographic copier, a photosensitive drum and a developing device for toner development of the electrostatic latent image formed on the photosensitive drum in correspondence with the image of the original, and a cleaner for removing any powder developing agent remaining on the photosensitive drum are integrally mounted on a support member, and this support member is slid with respect to the main body of the electrophotographic copier in the direction of the axis of the photosensitive drum for removal and mounting.

The expression "integrally mounted" as used herein means that the named components can be separately disassembled from the rest of the printing apparatus without being separated or disassembled from each other.

In the apparatus disclosed in the above publication, as set forth in the fourth column, the developing device, the photosensitive drum and the cleaner are integrated into a single exchangeable unit, and when either of them reaches the limit of life span, the entire exchangeable unit is exchanged for a new one.

Further, as described in column 6 and column 11, and shown in FIG. 2 in the publication, a toner bottle 20 is provided in the developing device A, and a powder developing agent formed by mixing the toner and the carrier is contained therein.

When the powder developing agent is exhausted, the exchangeable unit as a whole is at the limit of life span, and must be replaced regardless of the consumption or wear of other components. This leads to increase in the printing cost, and is detrimental to the economy of the user. The deficiency can be eliminated by increasing the capacity of the toner bottle, or by lowering the cost of the exchangeable unit. The former measure increases the size of the exchangeable unit, and the latter measure is technically difficult.

Of the components of the exchangeable unit, the toner bottle reaches the limit of life span when the powder developing agent contained therein is exhausted, but, at that time, other components may not have reached their limit of live span, and their limit of life span is dependent on factors other than the consumption of the powder developing agent, for instance the number of sheets that have been printed, and it is practically impossible to have the limit of life span of the toner bottle and all other components to reach simultaneously under various conditions.

For this reason, the user of the apparatus must dispose the exchangeable unit, part of which can still be used, and this is uneconomical to the user.

SUMMARY OF THE INVENTION

An object of the invention is to provide an electrophotographic printing apparatus with which waste of the components of the present image forming cartridge can be minimized.

As a means of solving the above problems, the present invention provides an electrophotographic printing apparatus which comprises a photosensitive drum, a primary charger, a developing agent tank, a developing means, and a cleaner, wherein the photosensitive drum, the primary charger, the developing means, a container for the developing agent tank, and the cleaner are integrally mounted to a support member to form an image-forming cartridge, and this cartridge is removable mounted to the main body of the electrophotographic printing apparatus, and the developing agent tank is removable mounted in the container of the cartridge.

With the electrophotographic printing apparatus of the above arrangement, when the powder developing agent is exhausted, it is sufficient if the developing agent tank is exchanged. Accordingly, it is possible to use the image-forming cartridge to its limit of life span while exchanging the developing agent tank.

Moreover, if the powder developing agent is still remaining in the tank when the image-forming cartridge has reached its limit of life span, the image-forming cartridge is removed from the main body, and the developing agent container that has been in use is removed, and then attached to a new image-forming cartridge, and this new image-forming cartridge is mounted to the main body. Waste of the powder developing agent is therefore avoided.

DETAILED DESCRIPTION OF THE PREFERRED EMBODIMENTS

An embodiment of the invention will now be described with reference to the drawings.

Figure 1:
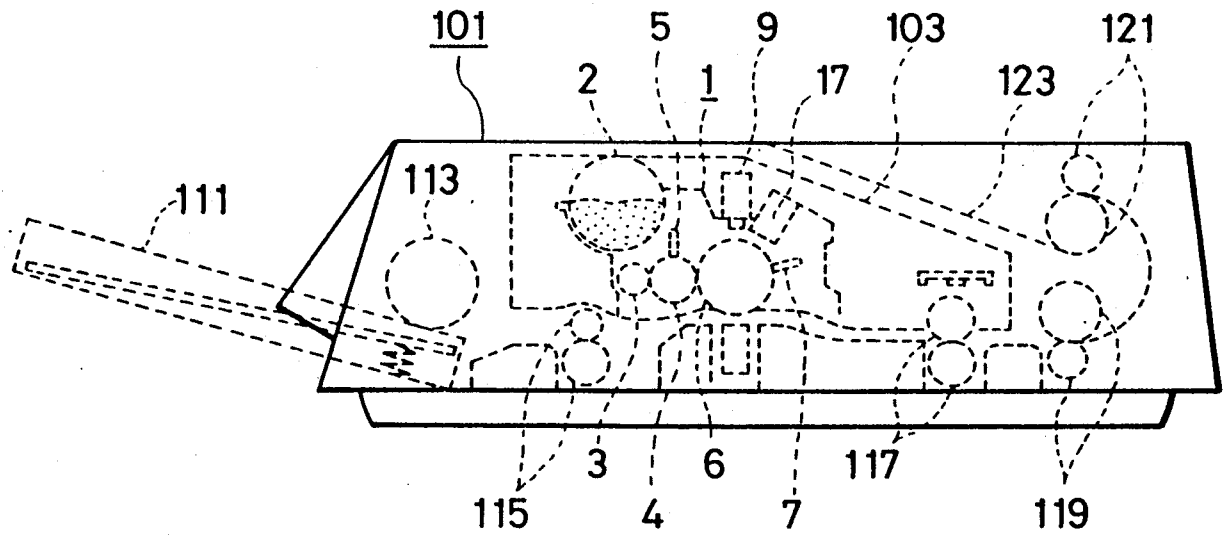
FIG. 1 is a side view showing the general construction of an embodiment of the invention.

Referring to FIG. 1, the electrophotographic printing apparatus of this embodiment comprises an outer housing or main body 101 to which a paper cassette 111, a paper pick-up roller 113, a pair of paper feed rollers 115, a pair of fixing rollers 117, another pair of paper feed rollers 119, a pair of paper eject rollers 121, and an image-forming cartridge 1 are provided. Paper that has been ejected by eject rollers 121 are placed and stacked on a printed paper tray 123.

The image-forming cartridge 1 is removable mounted in an internal frame 103 fixed in the main body 101. A developing agent tank 2 is removable mounted to the cartridge 1 and contains powder developing agent therein. A supply roller 3 is provided directly beneath the developing agent tank 2 for supplying the powder developing agent. A developing roller 4 is formed of an electrically conductive body and pressed against the supply roller 3. A toner blade 5 is pressed with a predetermined pressure against the developing roller 4. A photosensitive drum 6 has a photoconductive layer on its surface. The developing roller 4 is in contact with the photosensitive drum. A cleaner 7 is in contact with the surface of the photosensitive drum 6. A primary charger 17 is parallel with the central axis of the photosensitive drum 6. A light-emitting diode (LED) head 9 comprises a multiplicity of light-emitting diodes (LED's) disposed in the direction parallel with the central axis of the photosensitive drum 6 so as to illuminate the photoconductive layer on the surface of the photosensitive drum 6.

The supply roller 3, the developing roller 4 and the photosensitive drum 6 are supported to the support member of the image-forming cartridge 1, integrally and in parallel with each other, such that are rotatable. The toner blade 5, the cleaner 7, and the primary charger 17 are mounted to the support member of the image-forming cartridge, with a predetermined positional relationship with respect to the developing roller 4 and the photosensitive drum. The LED head 9 is positioned relative to the supporting member of the image-forming cartridge 1 as illustrated in FIG. 1, by means of a mechanism to be described later.

Figure 2:
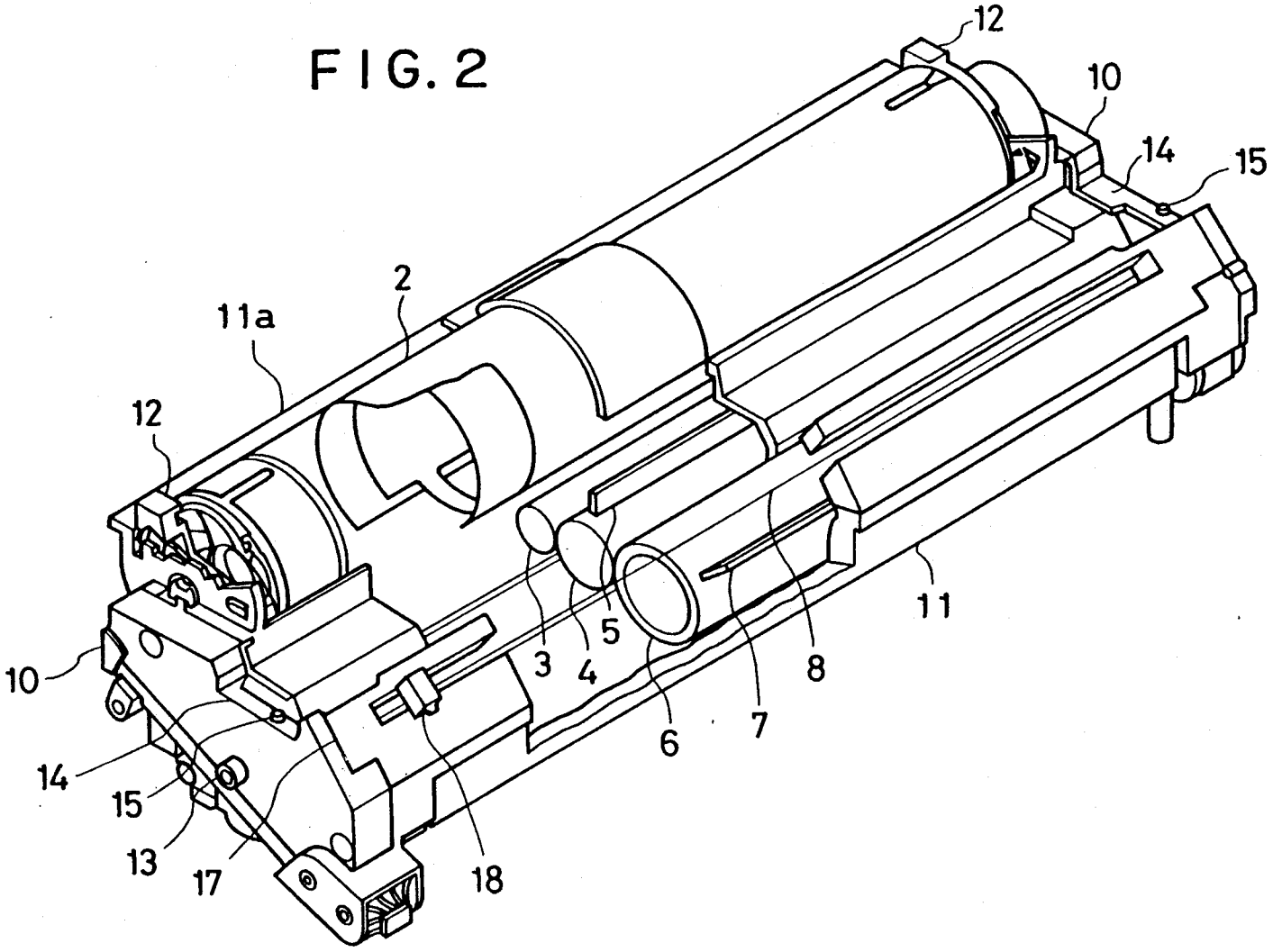
FIG. 2 is a perspective view showing the structure of the image forming-cartridge.

Details of the image-forming cartridge 1 are shown in FIG. 2. In the figure, side plates 10 are provided on the right and left of the image-forming cartridge 1. They are fixed to the cartridge case main body part 11, and form the side surfaces of the image-forming cartridge. The supply roller 3, the developing roller 4, and the photosensitive drum 6 are rotatably supported on the inner surfaces of the side plates via bearings, not shown. The side plates 10 support the primary charger 17 and the cleaner 7 such that they maintain a positional relationship with respect to the developing roller 4 and the photosensitive drum 6, respectively. That is, the supply roller 3, the developing roller 4, the photosensitive drum 6, the cleaner 7 and the primary charger 17 are positioned and supported by the side plates 10, in positions as illustrated in FIG. 1.

A developing agent tank-containing case 11*a* is to contact, at its bottom, the cartridge case main body part 11, and coupled to the cartridge case main body part 11, with a predetermined positional relationship with respect to the cartridge case main body 11, by means of the side plates 10. The developing agent tank-containing case 11*a* supports the developing agent tank 2, such that the tank 2 can be mounted and removed. The mechanism for supporting the developing agent tank 2 will later be described in detail.

The left side plate 10 has a positioning post 13 on the left surface thereof. The right side plate 10 also has a similar positioning post, not shown. This positioning post 13 is used for mounting of the image-forming cartridge 1 to the main body 101.

The side plate 10 has an LED head positioning flat surface 14, on its top, and an LED guiding projection 15 having a truncated cone. The positioning flat surface 14 and the guiding projection 15 are provided for accurate positioning with respect to the photosensitive drum 6, and determine the position of the LED head 9 when the LED head 9 is mounted to the image-forming cartridge 1, as described later.

The image-forming cartridge 1 has a developing agent collecting mechanism, not shown, provided in the image-forming cartridge 1 and moved together with the drive gear of the photosensitive drum 6. The developing agent collecting mechanism collects the powder developing agent that has been removed by the cleaner 7 from the surface of the photosensitive drum 6, to the bottom of the image-forming cartridge 1, and conveys the collected powder developing agent to the developing agent tank-containing case by means of a helical conveying means, for the purpose of re-using the powder developing agent.

The primary charger 17 is fitted on the image-forming cartridge 1. A corona discharge wire 8 is made to span in the primary charger 17, in parallel with the central axis of the photosensitive drum 6. The primary charger 17 is provided with a discharging wire cleaner 18 which clamps the corona discharging wire 8, and which can slide along the discharge wire 8.

Figure 3:
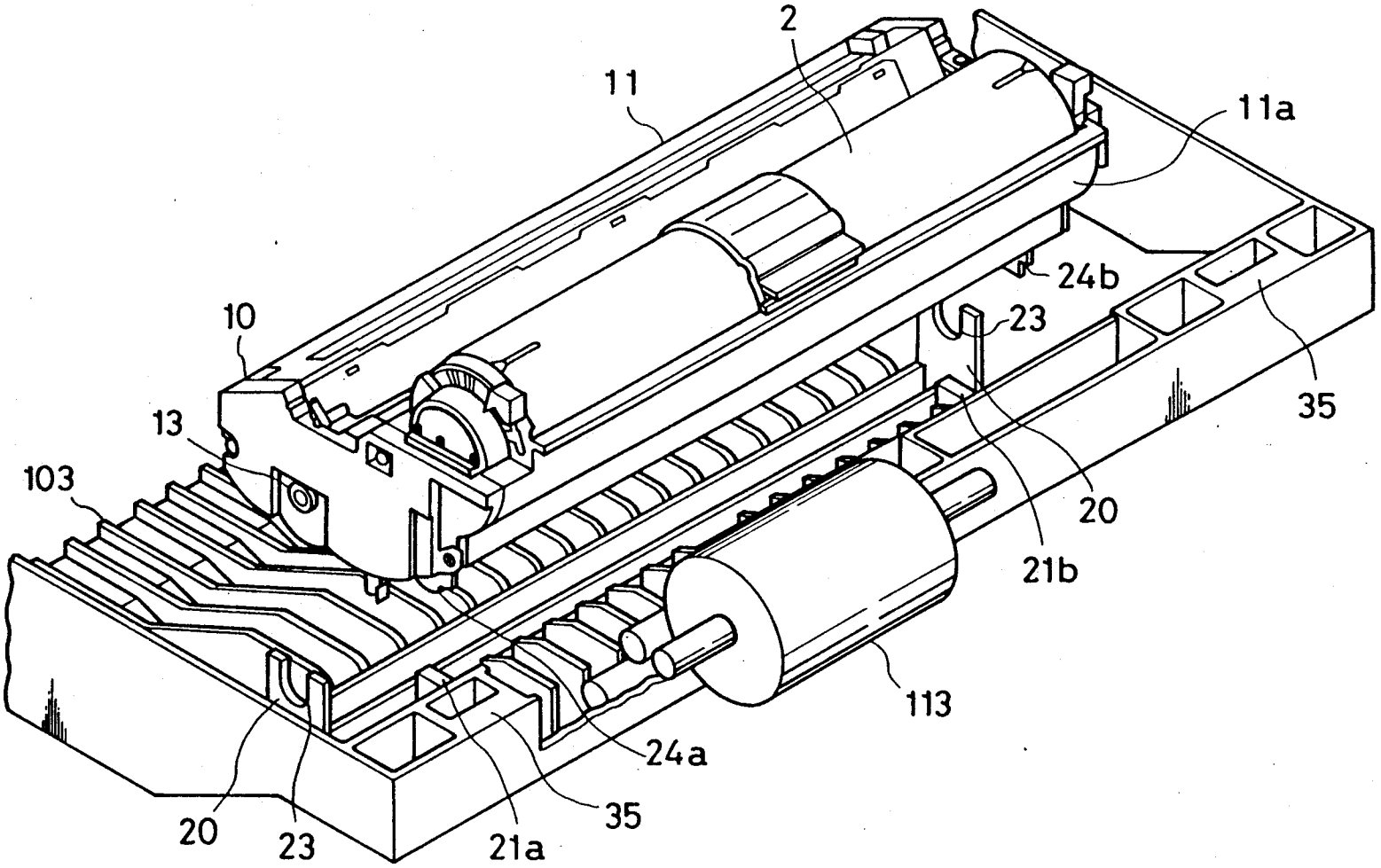
FIG. 3 is a perspective view showing the engagement section of the image-forming cartridge and the frame.

FIG. 3 shows a fixing means for fixing the image-forming cartridge 1 to the electrophotographic printing apparatus main body 101.

Figure 4:
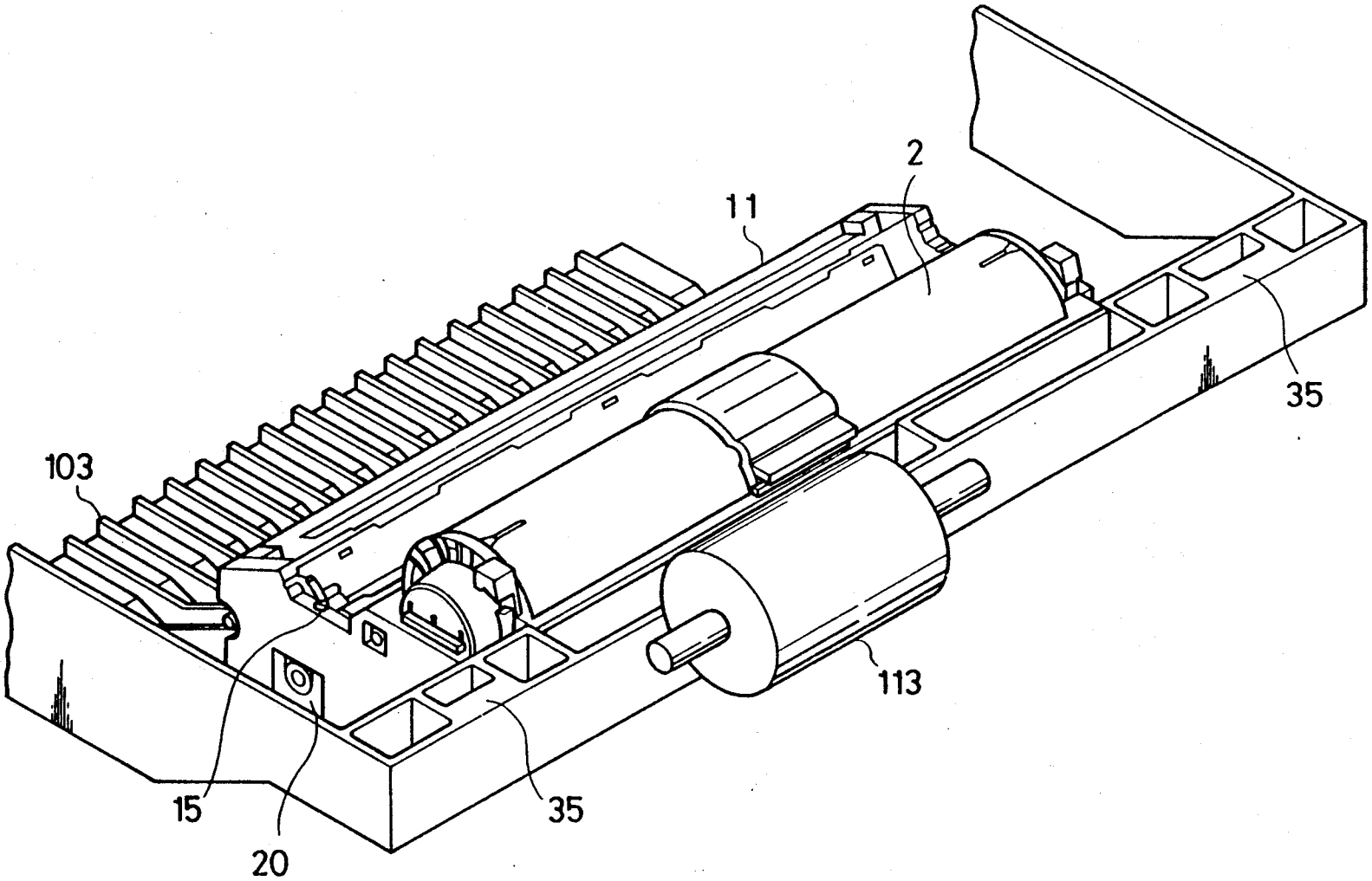
FIG. 4 is a perspective view showing the engagement between the frame and the image-forming cartridge.

Provided integrally with the frame 103 disposed in the main body 101 are a pair of supporting members 20 and a block 21*a* and 21*b*. Each of the supporting members 20 has a U-shaped cut-away 23 opening upward. This cur-away 23 engages positioning post 13 provided on the side plate of the image-forming cartridge 1 (see FIG. 4). In FIG. 3, the positioning post 13 is coaxial with the photosensitive drum 6. The supporting members 20 and the positioning posts 13 support the image-forming cartridge 1 in relation to the photosensitive drum 6.

With this arrangement, the positional relationship is determined between the photosensitive drum 6 and a transfer electrode, not shown, which is in opposition to the printing paper, not shown, and the photosensitive drum 6.

Further, blocks 21*a* and 21*b* which are integral with the frame 103, support a pair of abutment parts 24*a* and 24*b* provided on the image-forming cartridge 1. The engagement between blocks 21*a* and 21*b*, and the abutment parts 24*a* and 24*b*, prevents rotation of the image-forming cartridge 1 accompanying the rotation of the photosensitive drum 6, and maintains the positional relationship of image-forming cartridge 1 with the main body 101.

Figure 5:
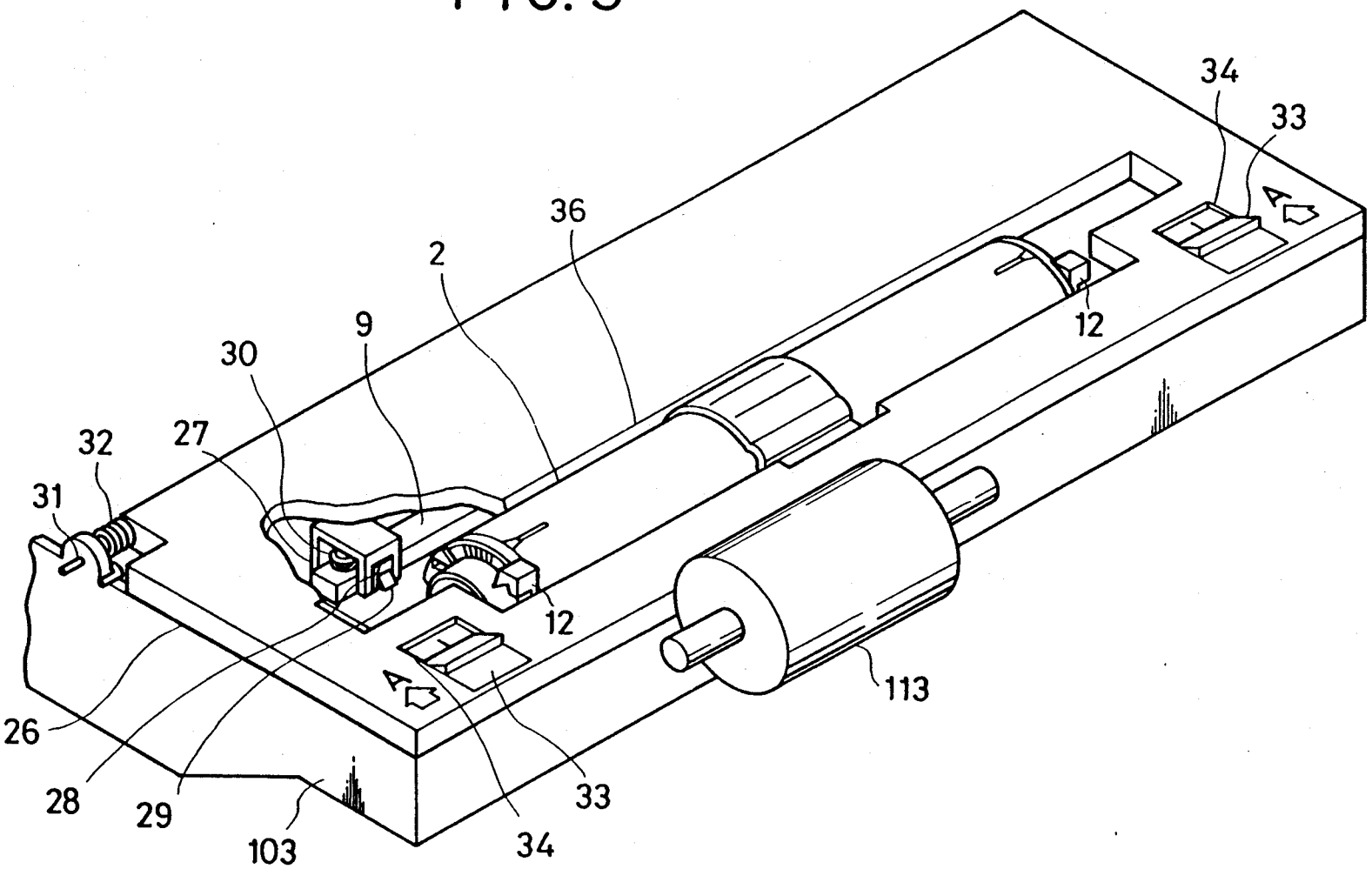
FIG. 5 is a perspective view showing the engagement between the LED head and the image-forming cartridge.

FIG. 5 shows the structure for positioning the LED head 9 with respect to the image-forming cartridge 1. In the figure, the frame 103 in which the image-forming cartridge is mounted is provided with an upper lid 26. This upper lid 26 is separate from the outer lid, not shown, which is provided at the top of the main body 101.

The LED head 9 is fixed to the inner surface of the upper lid 26. The upper lid 26 protects the printing section of the photosensitive drum 6.

A guide 27 is formed by bending a rectangular plate 28 having a rectangular perforation 28 (only one at one end being illustrated: other perforations are not seen in FIG. 5.) into the a shape with a channel-like cross section, and fixed at its central portion to the inner surface of the upper lid 26. Pairs of projections 29 (only one at one end being illustrated: others are not seen in the figure) are provided at each end of the LED head 9 and engage the perforations 28. A compression spring 30 has one end fixed to the guide 27 and the other end abutting against the LED head 9. The perforations 28 are larger than the projections 29, and the LED head 9 is therefore movable within the range in which the projection 29 is engaged with the perforation 28. In this state, the compression spring 30 biases the LED head 9 away from the upper lid 26.

A shaft 31 supports the upper lid 26 such that it is rotatable with respect to the frame 103. A torsion spring 32 has one end engaged with the frame 103, and the other end engaged with the upper lid 26 to bias the upper lid 26 upward. Knobs 33 are slidable along grooves 34 provided in the upper lid 26. Each knob 33 has a latch, not shown, which is integrally formed with the knob. This latch is engaged with the jaw portion 35 (FIG. 4) on the frame 103, and fixes the upper lid 26 to the frame 103. The frame 103 is also fixed to the main body 101 by an engagement means, not shown. When the knob 33 is moved in the direction of arrow A in FIG. 5, the latch is disengaged, and the upper lid 26 is released. The released upper lid 26 then is lifted by the biasing of the torsion spring 32.

A top window 36 is provided in the upper lid 26, directly over the developing agent tank 2.

When the image-forming cartridge 1 is mounted to the frame 103 and the upper lid 26 is closed, the LED head 9 is brought to contact with the image-forming cartridge 1. The guiding projections 15 provided on the side plates 10 are engaged with guide perforations, not shown, provided at predetermined locations on the lower surface of the LED head 9.

The compression spring 30 presses the LED head 9 against the positioning flat surfaces 14.

The guiding projections 15 have a truncated cone shape, while the LED head 9 having the guiding perforations is movable within a predetermined range with respect to the guide 27, so the positional relationship between the image-forming cartridge 1 and the LED head 9 is accurately corrected by the guiding projections 15, the guiding perforations, and the positioning flat surfaces 14.

To remove the image-forming cartridge 1, the outer lid, not shown, at the top of the main body 101 is first opened, and the knobs 33 are removed in the direction of arrow A, and the upper lid 26 is opened, and the image-forming cartridge 1 is then lifted upward.

When the developing agent tank 2 alone is to be removed, the upper lid 26 is kept closed, and the engagement members 12 are manipulated in a manner to be described later, and the developing agent tank 2 is removed through the top window 36, from the image-forming cartridge 1. In this way the developing agent tank 2 can be removed alone through the top window 36 without removing the image-forming cartridge 1. A similar but opposite procedure is followed when the developing agent tank 2 is mounted.

The configuration for mounting and removing the developing agent tank 2 to or from the image-forming cartridge 1 will now be described.

Figure 6:
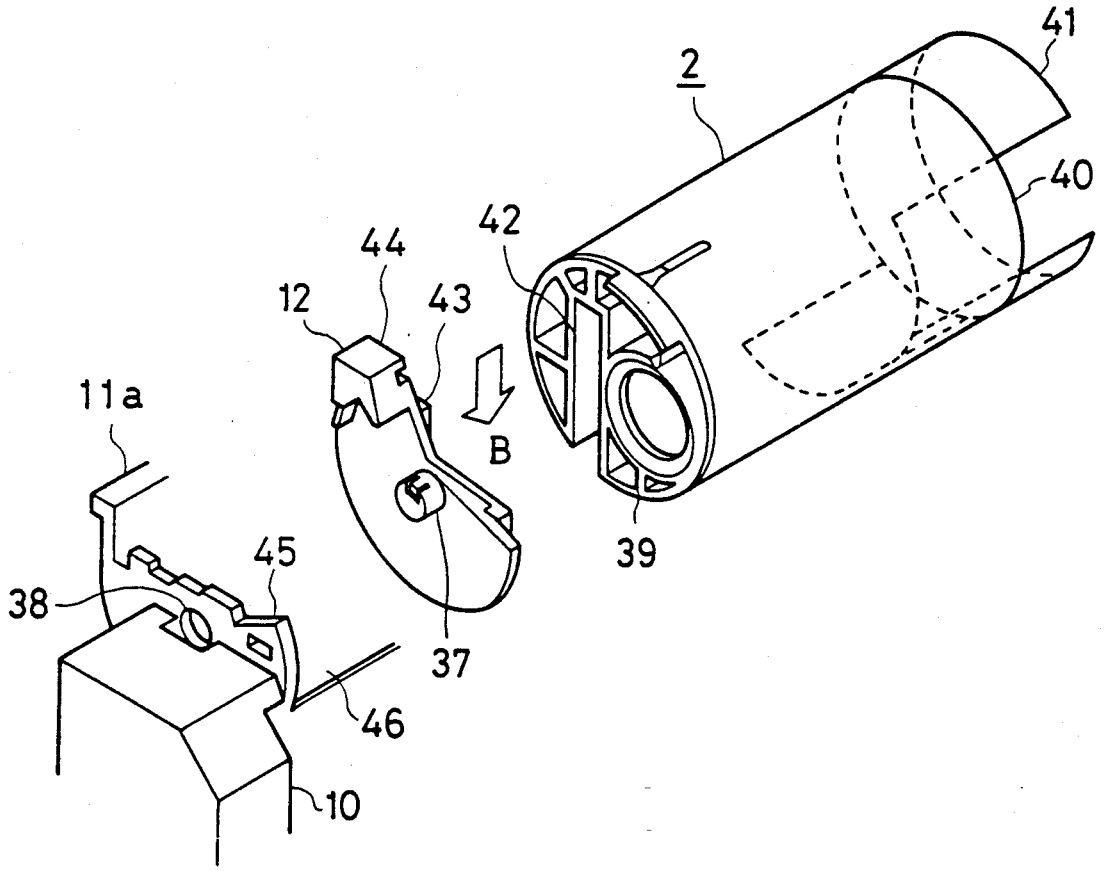
FIG. 6 is a perspective view showing the means for fixing the developing agent tank.

In FIG. 6, a shaft 37 is formed integrally with the engagement member 12. A perforation 38 is provided in the side plate of the developing agent tank-containing case 11*a*. The developing agent tank 2 has a side plank 39, an outer cylinder 40 and an inner cylinder 41. The side plank is provided with a groove 42. An elongated projection 43 is provided on the inner side of the engagement member 12. The engagement member 12 is provided with a grip 44. A limiter 45 is provided for stopping the rotation of the grip 44 at a predetermined position.

By inserting the shaft 37 in the perforation 38, the engagement member 12 is held to the side plate of the developing agent tank-containing case 11*a* such that it can rotate. The side plank 39 is fixed to the end of the inner cylinder 41 of the developing agent tank 2. With the rotation of the side plank 39, the inner cylinder 41 rotates relative to the outer cylinder 40.

The developing agent tank-containing case 11*a* has a semi-circular hollow part 46 which is opened upward to receive the developing agent tank 2. The hollow part 46 has, at its bottom, an opening, not shown, which communicates with the developing section, and the developing agent in the developing agent tank is supplied through this opening to the developing section.

Figure 7:
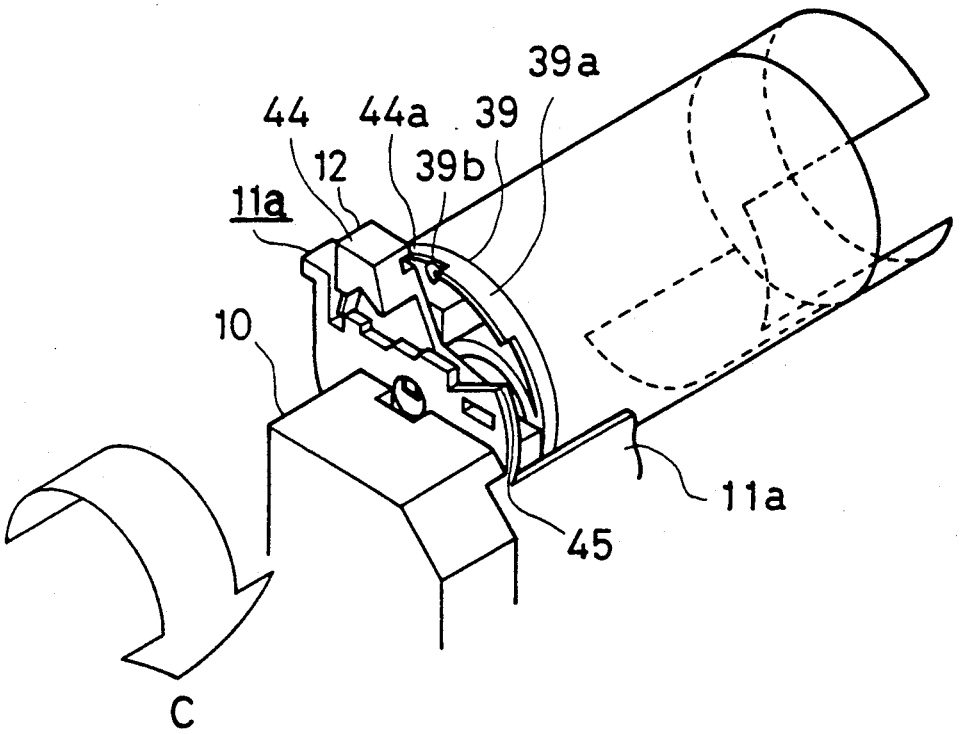
FIG. 7 is a perspective view showing the state in which the developing agent tank is fixed.

To mount the developing agent tank 2, the groove 42 of the side plank 39 is made to assume the same direction as the elongated projection 43 of the engagement member 12, and the developing agent tank 2 is inserted from above in the direction of arrow B such that the groove 42 engages with the elongated projection 43. FIG. 7 shows the state after insertion. The grip 44 is then rotated in the direction of arrow C. As a result, a groove 44*a* provided on the inner side of the grip 44 is pushed up onto a step portion 39*b* provided in front of a tab 39*a* of the side plank 39, whereby the developing agent tank 2 is pushed downward, and is fixed to the developing agent tank-containing case 11*a*. When the grip 44 is further rotated in the same direction it abuts against the end of the tab 39*a* to rotate the side plank 39. The outer cylinder 40 is fixed and prevented from rotating by a limiter, not shown. Accordingly, after the grip 44 is rotated to the limiter 45, the inner cylinder 41 of the developing agent tank 2 rotates together with the rotation of the side plank 39, and its opening, not shown, is superimposed with an opening, not shown, of the outer cylinder 40 and the developing agent contained therein can flow out. The above-mentioned opening is also superimposed with the opening at the bottom of the hollow part 46 of the developing agent tank-containing case 11*a*, and the developing agent therefore is supplied through the bottom of the containing case 11*a* to the developing section.

When the developing agent tank 2 is removed from the image-forming cartridge 1, a procedure opposite to that described above is followed: the grip 44 is rotated in the direction opposite to the arrow C, to the original position, and the tank is pulled upward. During the rotation of the grip 44 to the original position, the developing agent tank 2 and the inner cylinder 44 are rotated in the direction opposite to that described above, and the opening is thereby closed.

As has been described, according to the invention, the photosensitive drum and the developing means for supplying the power developing agent to the surface of the photosensitive drum, and the cleaner for removing the developing agent from the surface of the photosensitive drum are integrally mounted to the support member to form an image-forming cartridge, and the cartridge is removably mounted to the main body of the electrophotographic printing apparatus, and the developing agent tank is removably mounted to the cartridge. It is therefore possible to exchange the cartridge alone or the developing agent tank alone. The cost associated with the use of the apparatus is reduced.

Moreover, since the components forming the cartridge, e.g., the photosensitive drum, are not handled by themselves, there will be no toner scattering, and convenience is improved.

Furthermore, by integrally forming the cleaner and the developing device, the toner re-using mechanism, which is described earlier, is realized.

What is claimed is:

1. An electrophotographic printing apparatus comprising:

a photosensitive drum having a photoconductive layer on its surface;

a primary charger for uniformly charging the surface of the photosensitive drum;

a developing agent tank for containing powder developing a container for containing said developing agent tank;

a developing means for supplying the powder developing agent supplied from the developing agent tank to the surface of the photosensitive drum;

a cleaner for removing the powder developing agent from the surface of the photosensitive drum;

an image-forming cartridge containing said photosensitive drum, said primary charger, said developing means, said container, and said cleaner; and a print head for forming an electrostatic latent image on the photosensitive drum;

wherein a visible image using the powder developing agent corresponding to the electrostatic latent image formed on the photosensitive drum is formed, and the visible image is transferred to the surface of a printing paper to achieve printing;

said apparatus further comprising:

a frame mounted in a main body of said apparatus and having an opening which faces upward; and and openable lid mounted on said frame, covering said opening of said frame, and having a window;

said print head being fixed on an inside surface of said lid and placed at a predetermined position with respect to said photosensitive drum when said lid is closed;

said image-forming cartridge being mountable to said frame and removable from said frame only when said lid is opened; and said developing agent tank being mountable into said container of said cartridge and removable from said container of said cartridge through said window of said lid when said lid is closed.

2. The apparatus of claim 1, wherein said developing agent tank has an inner cylinder having an opening, and an outer cylinder having an opening which does not overlap the opening of said inner cylinder when the developing agent tank is not mounted in said image-forming cartridge; and said container has an opening overlapping said opening of said outer cylinder when said developing agent tank is mounted in said container;

said apparatus further comprises means for rotating said inner cylinder relative to said outer cylinder such that said opening of said inner cylinder, said opening of said outer cylinder, and said opening of said container overlap each other, to permit supply of developing agent to the developing means.

3. An electrophotographic printing apparatus, comprising:

a main body, said main body including a plurality of paper transporting rollers;

a frame mounted in the main body of said apparatus and having an opening which faces upward;

an operable lid mounted on said frame, covering said opening, and having a window;

an image-forming cartridge removably mounted to said main body, said image-forming cartridge including a photosensitive drum having a photoconductive layer on its surface, and means for supplying developing agent to the photosensitive drum wherein said image-forming cartridge being mountable to said frame and removable from said frame only when said lid is opened; and a developing agent tank removable mounted to said image forming cartridge and removable through said window when said lid is closed.

4. The apparatus of claim 1 wherein said developing agent tank includes an inner cylinder having an opening and an outer cylinder having an opening, said inner cylinder being independently rotatable such that the opening of the inner cylinder can be aligned with the opening of the outer cylinder.

5. The apparatus of claim 1 wherein the print head is mounted to the upper lid in such a way that it is movable relative to the upper lid.

6. The apparatus of claim 1 further comprising a biasing means for biasing the print head away from the upper lid.

* * * * *